US005662454A

United States Patent [19]

Baufreton et al.

[11] Patent Number: 5,662,454

[45] Date of Patent: Sep. 2, 1997

[54] DEVICE FOR AUTOMATICALLY FILLING A CONTAINER FOR COLLECTING FLAT OBJECTS

[75] Inventors: Laurent Baufreton, Nantes; Henri Barjolle, Haute Goulaine; Didier Thieriot, Nantes, all of France

[73] Assignee: La Poste, Paris, France

[21] Appl. No.: 517,403

[22] Filed: Aug. 21, 1995

[30] Foreign Application Priority Data

Jun. 20, 1994 [FR] France ..... 94-07536

[51] Int. Cl.[6] ..... B65H 31/06

[52] U.S. Cl. ..... 414/798.2; 271/2; 414/907; 414/790.5

[58] Field of Search ..... 414/789.9, 790.5, 414/790.6, 798.2, 798.5, 798.8, 907; 271/2

[56] References Cited

U.S. PATENT DOCUMENTS

| | | | |
|---|---|---|---|
| 3,082,885 | 3/1963 | Williamson | 414/790.6 |
| 3,228,538 | 1/1966 | Coates | 414/790.5 |
| 3,865,365 | 2/1975 | Hardin et al. | 414/798.5 |
| 4,162,870 | 7/1979 | Storm | 414/790.5 |
| 4,237,677 | 12/1980 | Klapp | 414/798.5 |
| 4,518,160 | 5/1985 | Lambrechts et al. | 414/798.5 |
| 5,452,985 | 9/1995 | Roch et al. | 414/798.2 |

FOREIGN PATENT DOCUMENTS

| | | | |
|---|---|---|---|
| 0513732 | 11/1992 | European Pat. Off. . | |
| 0550758 | 7/1993 | European Pat. Off. . | |
| 0559553 | 9/1993 | European Pat. Off. . | |
| 2646620 | 11/1990 | France . | |
| 895864 | 1/1982 | U.S.S.R. | 414/790.5 |

*Primary Examiner*—Karen B. Merritt
*Assistant Examiner*—Gregory A. Morse
*Attorney, Agent, or Firm*—Roland Plottel

[57] ABSTRACT

Device for automatically filling a container for collecting flat objects, such as mail envelopes, including a receiving location where the envelopes are delivered one by one, preferably in a vertical position and stood up on their edge, from a conveyor, in particular with driving belts pinching the envelopes between them until the moment when they are released into the location in order progressively to form a stack, this location including at least one and preferably two opposite parallel jogging edges extending perpendicularly to the planes of the successive envelopes in the stack formed between these edges, and a horizontal bearing sole, the first envelope in the stack furthermore being pressed against a moving stop which moves in a horizontal direction as the stack is formed, wherein the bearing sole consists of two retractable flaps placed facing one another in the same horizontal plane in order to support the stack of envelopes, these flaps being mounted so that they can pivot about two parallel axles and operated in synchronism from a mechanism able to cause them to tilt simultaneously about these axles so that the stack thus released drops under gravity between the separated flaps into the collecting container located underneath these flaps at the receiving location.

12 Claims, 3 Drawing Sheets

DEVICE FOR AUTOMATICALLY FILLING A CONTAINER FOR COLLECTING FLAT OBJECTS

BACKGROUND OF THE INVENTION

1. Field of the Invention

The present invention relates to a device for automatically filling a container for collecting flat objects, especially such as mail envelopes conveyed through a sorting installation by means of a conveyor device and delivered to a receiving location where these envelopes are progressively stacked up, each stood up on their edge in a vertical plane one behind the other.

2. Description of the Prior Art

Mail sorting installations of this kind are already known in which the envelopes, after passing for example past a machine which orientates them as a function of the reading of written or printed codes on their surface identifying the destination of the mail, and sends them to an appropriate receiving location in which they are stored in the form of a stack built up progressively from these envelopes placed in succession one against the other in this location.

In these conventional embodiments the envelopes, in each receiving location, are guided against one, or alternatively held between two, vertical parallel edge plates extending perpendicularly to the plane of the envelopes in the stack, the latter growing uniformly with the number of these envelopes which become incorporated into the stack, further more progressively pushing back a moving stop which presses against the first envelope in this stack, and which moves back under the effect of the pressure of these envelopes as these are gradually distributed into the receiving location.

When the stack of envelopes reaches a given thickness, corresponding substantially to the length of a receiving container, these envelopes have to be picked up simultaneously and placed in this container, this operation generally being carried out by hand or with means for moving the stack en masse, which are complicated and difficult to adjust accurately and quickly.

SUMMARY OF THE INVENTION

The subject of the present invention is a device for filling a receiving container with envelopes forming a stack built up beforehand, which is reliable and especially operates automatically, and also has great reliability as far as the correct placing of the envelopes into this container without destroying or scattering the stack is concerned, the envelopes being permanently guided throughout their movement from the receiving location where the stack is formed, until they have finished being transferred into the container.

The invention also concerns a device which can be used with great speed, the new envelopes delivered to the receiving location by an appropriate conveyor line and which are to be stored temporarily remaining in very small numbers during the time when the previously built-up stack is transferred en masse to the container before these envelopes can begin to form a new stack for the subsequent filling of another container which is substituted for the one into which the previous stack was placed.

Finally, a subject of the present invention is a device of low cost which can be adapted to containers of different sizes, the dimensions of these containers having no direct influence over the operation of the mechanism employed, the simplicity of which is moreover particularly appreciable.

To this end, the device in question, including a receiving location where the envelopes are delivered one by one, preferably in a vertical position and stood up on their edge, from a conveyor, in particular with two driving belts pinching the envelopes between them until the moment when they are released into the said location in order progressively to form a stack, this location including at least one and preferably two opposite parallel jogging edges extending perpendicularly to the planes of the successive envelopes in the stack formed between these edges, and a horizontal bearing sole, the first envelope in the stack furthermore being pressed against a moving stop which moves between the edges in a horizontal direction parallel to the edges as the stack is formed, is characterized in that the bearing sole consists of two retractable flaps placed facing one another in the same horizontal plane in order to support the stack of envelopes, these flaps being mounted so that they can pivot about two parallel axles and operated in synchronism from a mechanism able to cause them to tilt simultaneously about these axles so that the stack thus released drops under gravity between the separated flaps into the collecting container located underneath these flaps at the receiving location.

According to a particular feature of the device in question, the moving stop includes at least one guide roller which is free to rotate about a horizontal axle parallel to the plane of the envelopes and able to guide the stack as it moves towards the collecting container. For preference, the stop consists of a plurality of superimposed rollers graded according to the height the envelopes.

Advantageously, the device includes a second stop which can be pressed against the last envelope in the stack once this stack has been formed, prior to the mechanism causing the two retractable flaps to tilt being operated to drop the stack into the collecting container, this second stop preferably including, like the moving stop, rollers for guiding the envelopes, the stack being held laterally as it drops between the rollers of the two stops.

According to another feature, the second stop is borne by a pivoting arm articulated about a vertical axle so as to allow either sufficient clearance from this stop as the stack is being formed or the pressing of this stop against the last envelope of the stack at the moment when the operating mechanism causes the two retractable flaps to tilt.

Also by way of preference, the moving stop includes a crosspiece exhibiting two lateral extensions which are equipped with means able to move the stop along two rails or the like of a structure provided in the receiving location, these rails guiding the stop in its movement. Relays are advantageously mounted at the end of the rails, the contact of which is actuated by the crosspiece of the moving stop at the end of its travel, so as to determine the instant at which the stack is finished and operate the tilting mechanism of the retractable flaps.

According to yet another feature, the crosspiece of the moving stop is returned to its initial position after the stack has been transferred into the collecting container following the tilting of the retractable flaps, by means of a return member, of the spring-loaded type or of the type including a counterweight.

By way of preference, and according to an additional feature, the receiving location includes slideways for supporting the collecting container, these slideways being located underneath the retractable flaps, allowing the container to be changed after the stack has been transferred, with a view to collecting another stack formed in the receiving location. These slideways may, as appropriate, have variable positioning and variable separation in order to accommodate various sizes of container, depending on the format of the envelopes in particular.

Once again, and in the preferred embodiment of the invention, each of the retractable flaps includes a flat bottom with a lateral return forming a jogging edge for the envelopes in the stack, this return being equipped with a clevis through which the pivot axle of the flap passes, this clevis further being secured to a link rod articulated to a double-acting ram located parallel to the plane of the bearing role of the stack, so that extending or contracting this ram determines the pivoting of the link rod for each flap and causes the two flaps to tilt or to come to face one another in the same horizontal plane.

By way of preference, the link rods between the two flaps and the double-acting operating ram are mounted at the opposite end of the receiving location to the belt conveyor. Also by way of preference, the retractable flaps are made to tilt by a stroke of the ram such that the separation between the edges of the envelopes relative to these flaps as the stack drops corresponds substantially to the width of these envelopes.

Finally, and advantageously, the ram is operated so as to create a strong acceleration as it extends in order to obtain rapid-tilting of the retractable flaps, followed by deceleration at the end of its travel before the movement stops, in order to prevent the flaps from bouncing.

Other features of a device for automatically filling a collecting container according to the invention will further emerge through the description which follows of one embodiment, given by way of non-limiting indication, with reference to the appended drawings in which:

DESCRIPTION OF THE PREFERRED EMBODIMENT

Figure 1:
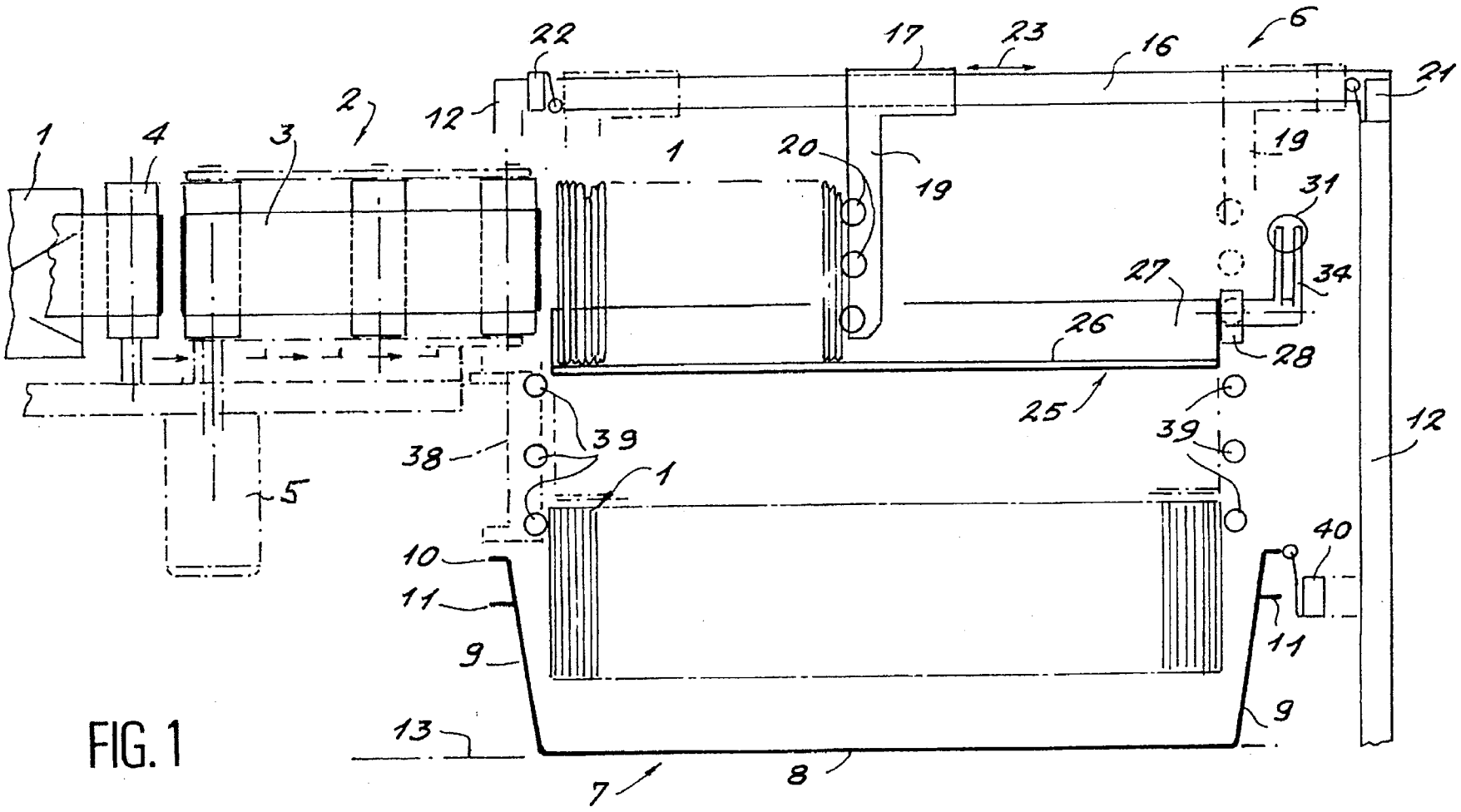
FIG. 1 is a side elevation of the device in question.

In FIG. 1, the reference 1 denotes flat objects such as mail envelopes, these being conveyed in a way which is in itself conventional, through a sorting installation by a conveyor 2 including taut belts 3 travelling over rollers 4, one or more of these being made to rotate by a drive motor 5. In the conveyor, the envelopes 1 are pinched between two neighbouring belts 3 which convey them through the installation and are preferably situated vertically between these belts, before the latter deliver them to a receiving location 6 where these envelopes are placed, still vertically, but in a plane which forms a given angle with respect to the direction of travel of these envelopes between the belts 3 when they leave the latter to enter the location 6.

Figure 2:
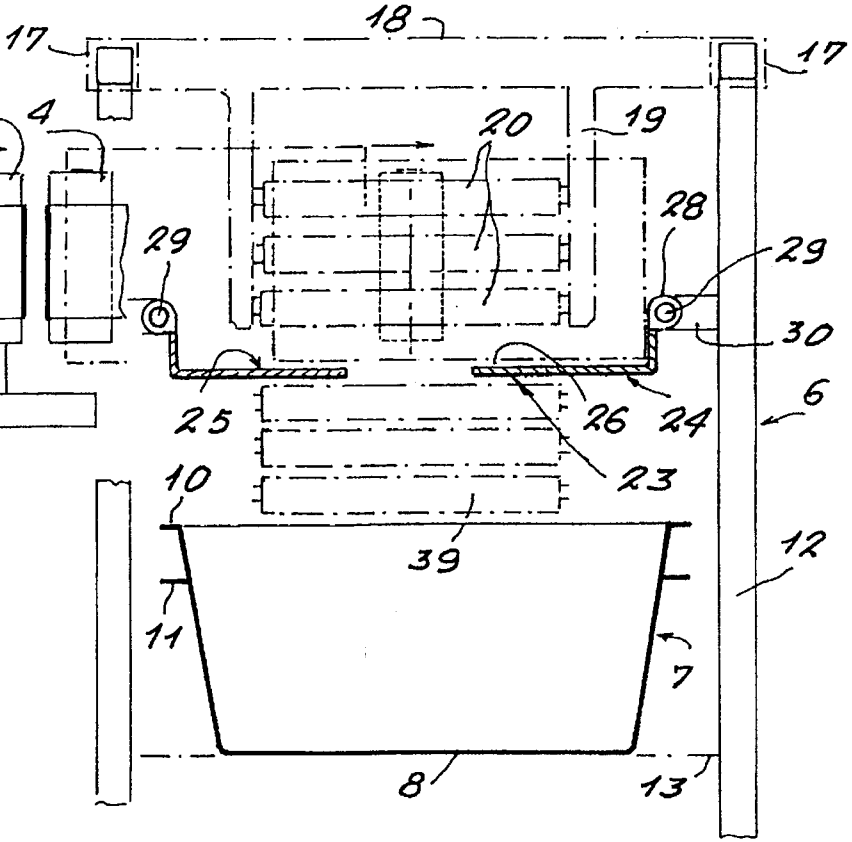
FIG. 2 is an end elevation of the device in a direction perpendicular to that which corresponds to FIG. 1.
Figure 4:
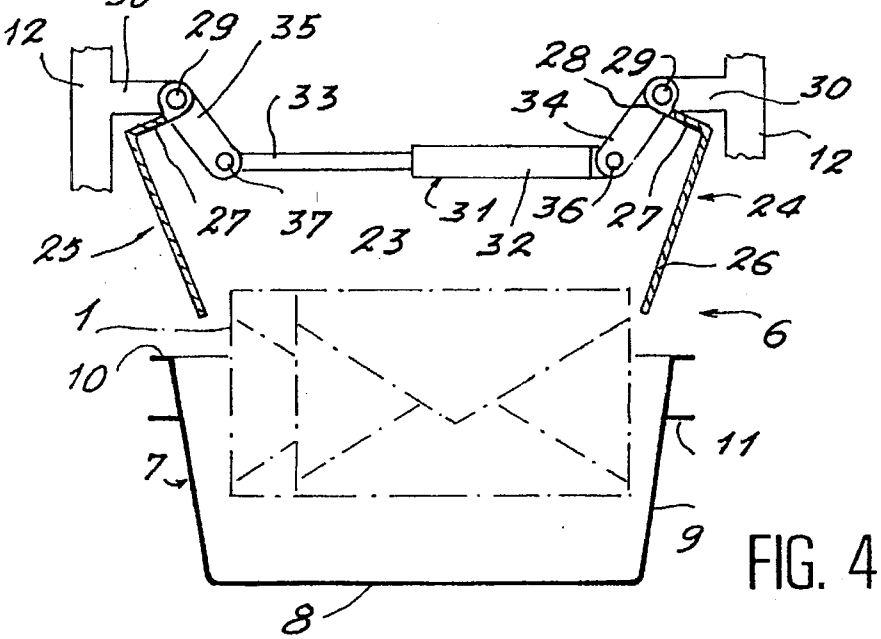
FIG. 4 is a side view of the collecting container and of the device for making the retractable flaps tilt.
Figure 3:
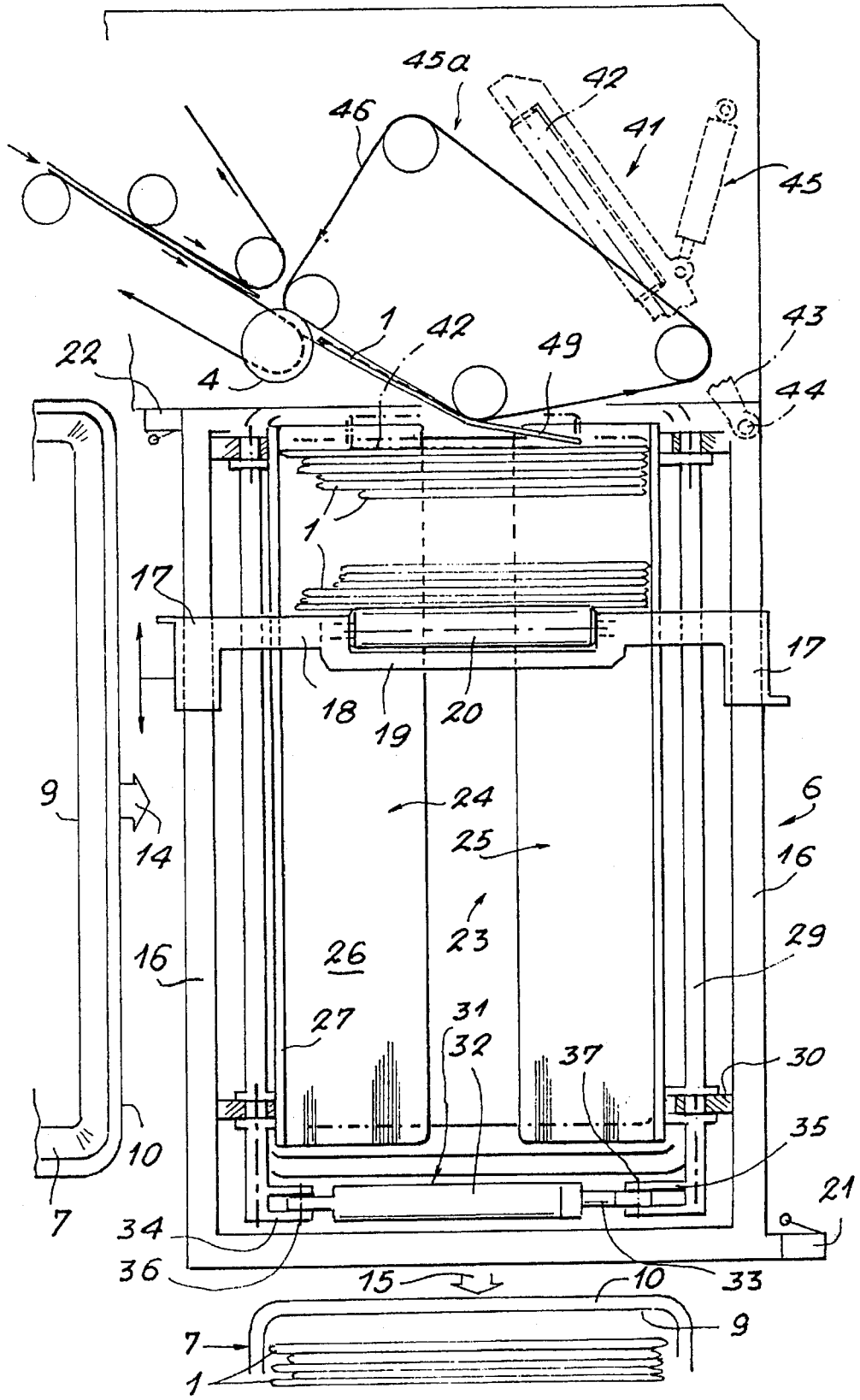
FIG. 3 is a plan view of the device.

In this location there is a collecting container 7 viewed in elevation and in section in FIG. 1, from the side in FIGS. 2 and 4, and in plan view in FIG. 3.

This container 7, of parallelepipedal overall shape, is preferably slightly flared at the top, has a bottom 8, lateral sides 9, and preferably upper edges 10 folded down outwards. The dimensions of this container are such that it is suitable for containing a stack of envelopes 1, previously formed in the receiving location 6 as these envelopes arrive in this location from the conveyor 2.

Handles 11 are provided laterally on two sides of the container 7, at least to allow it to be gripped and handled, both when this container is empty and introduced into the location 6 to receive a stack of envelopes and when this container is filled with this stack, in which case it can be extracted from this location and replaced by another empty container to receive the next stack, and so on.

The receiving location 6 has a rigid structure formed of vertical posts 12 joined together by a slideway or horizontal platform 13 (FIG. 1 and 2) on which the container 7 to he filled with the stack of envelopes 1 may be located, underneath it, the empty container being moved, for example, in the direction of the arrow 14 and removed from the location 6 once the stack of envelopes 1 has been placed in this container in the direction of the arrow 15.

The rigid structure delimiting the receiving location 6 moreover includes two horizontal guides or rails 16 parallel to one another and to the turned-down edges of the container 10 located underneath these rails. Extensions or adaptor pieces 17 are mounted so that they can slide on these rails and are joined together by a crosspiece 18 which can move above the container 7 when the latter is brought to the receiving location 6, this crossmember including a central part 19 in the form of a clevis, designed to support a moving stop formed of one and preferably several rollers 20 each turning freely on a horizontal supporting axle.

Thus, and in the embodiment represented, the moving stop supported by the crossmember 18 supports three superimposed rollers 20 with parallel axles (FIG. 2), these rollers being located in a vertical plane which is itself parallel to that in which the envelopes 1 forming the stack produced progressively in the location 6 above the container 7 are situated.

Relays, respectively 21 and 22 (FIG. 3) are provided at the ends of the rigid structure of the receiving location 6 close to the guides 16 thereof, these relays being intended to interact with the sliding adaptor pieces 17 of the crosspiece 18 so as to identify the extreme positions of the moving stop formed by the rollers 20, respectively before the beginning of the formation of the stack, that is to say before the first envelope arrives in this stack on the one hand, and when the stack is completed, on the other hand, the moving stop being pushed back by the envelopes to the opposite end of the location 6, prior to the moment when, as described hereafter, this complete stack is transferred to the collecting container 7 situated below in a single movement.

A return mechanism (not represented), of the spring-loaded type or the type having a counterweight, is associated with the crosspiece 18, so that after the stack of envelopes has been discharged when the moving stop is in the furthest-away position and has activated the relay 21, this mechanism is put into operation to return the crosspiece to the initial position until the relay 22 this time is actuated, this mechanism then being put out of operation.

The envelops 1 when delivered from the conveyor 2 to the receiving location 6 are stood up vertically, resting on their lower edge against a lower bearing sole 23 made up, in accordance with the invention, by two retractable flaps 24, 25 located side by side and under the stack but above the container 7 itself set in place underneath.

Each of the flaps 24 or 25 includes a flat bottom 26 and a lateral return 27 at right angles, so that when the bearing sole 23 is formed by the bottoms 26 of the two flaps placed facing one another in one and the same horizontal plane, the returns 27 of these flaps extend vertically, forming two lateral jogging edges for the envelopes 1 as the stack is formed in the location 6, at the same time as these envelopes progressively cause the movement of the moving stop consisting of the rollers 20.

The ends of the returns 27 of the flaps 24 and 25 are moreover equipped with a tubular element 28 in which there is mounted an axle about which these flaps tilt about stationary brackets 30 borne by the rigid structure.

Moreover, the flaps 24 and 25 are associated with a mechanism for causing them to tilt simultaneously, this mechanism has a double-acting ram 31, the body 32 and rod 33 of which are respectively articulated, at 36 and 37, to two levers 34 and 35 secured to the corresponding end of the pivot axles 29 of these flaps, as represented more particularly in FIGS. 3 and 4.

The equipment of the receiving location 6 is finally completed by a stationary support 38 for other rollers 39 mounted to rotate freely about horizontal axles, these rollers being situated on either side of the retractable flaps 24 and 25 ahead of and beyond the latter in the direction of formation of the stack of envelopes 1, the rollers 39 situated at the opposite end of the conveyor 2 being located substantially in the extension of the rollers 20 borne by the moving stop when the latter is at the end of its travel, that is to say when the adaptor pieces 17 come to act on the relay 21 (see FIG. 1).

Another relay 40 is provided in the rigid structure for detecting the insertion or removal of a container 7 under the retractable flaps (FIG. 1). In addition, the device includes an additional stop for holding the stack of envelopes, this stop has a pivoting lever 41 (FIG. 3) which, like the clevis 19 of the crosspiece 18, supports superimposed rollers 42 of horizontal axle, preferably equal in number to the number of rollers 20 on this crosspiece, so as to grip the stack between these two sets of rollers when the stack has finished being formed, prior to the moment at which the complete stack is transferred into the collecting container 7.

To this end, the pivoting lever 41 includes an extension 43, articulated to the rigid structure at 44, especially at the end of one of the rails 16, under the effect of a ram 45.

Finally, the receiving location 6 is associated with a stacking head (FIG. 3) denoted diagrammatically under the reference **45*a* and capable of picking up the envelopes leaving the conveyor 2 in order to place them in the stack above the bearing sole 23 formed by the retractable flaps 24 and 25, the first envelope pressing against the moving stop, pushing the latter back as the stack is formed. This head in the example represented includes a belt 46 closed up on itself and capable of driving along the envelopes delivered by the conveyor 2 in order to convey them into the stack, with an appropriate orientation in the receiving location 6 by virtue of a deflector 49 associated with the belt 46**.

The operation of the device according to the invention can easily be deduced from the foregoing description:

With an empty collecting container 7 having previously been placed on the slideway 13 under the sole 23, the relay 40 controlling this positioning, the flaps 24 and 25 are facing one another with their flat bottoms 26 in one and the same horizontal plane. In this situation, the conveyor 2 feeds the receiving location 6 with the envelopes 1 which become placed one behind the other in succession against the moving stop of the crosspiece 18, the stack being formed progressively as this stop moves back towards the opposite end of the location.

When the stack is formed, the lever 41 is pivoted by the ram 45 to bring the rollers 42 behind the stack. At the same time, the adaptor pieces 17 of the crosspiece 18 operate the relay 21 which, in turn, acts on the ram 31 so that the latter gives the levers 34 and 35 an abrupt excursion about their axles 29, the flaps 24 and 25 tilting abruptly and separating from each other.

In this position, the stack of envelopes which is guided laterally by the rollers 20 and 42 on the one hand, by the rollers 39 on the other hand situated beneath and in the extension thereof, is conveyed directly into the container 7 without the possibility of its orderedness becoming dispersed, the tilting of the flaps being such that the opening of the passage created between their facing edges is sufficient not to halt or even to touch the stack which therefore drops freely into the container.

At that moment, the flaps are closed up again in order to return to the position in which their bottoms again form the bearing sole 13, it being possible for the container 7 to be removed and replaced with another empty container at the same time as a new stack again forms in the receiving location, the envelopes being conveyed thereto by the stacking head **45*a*, comprising the belt 46 and the deflector 49**.

A device for automatically filling a container for collecting flat objects in a stack, especially mail envelopes, with very simple design and which affords numerous advantages is thus produced.

The time taken to release a stack and place it in a container may be very short, and in particular may exceed one to two seconds, it further being possible for the device to be used with a great variety of containers of different dimensions from one another. The mechanisms used to cause the tilting of the flaps is a simple double-acting ram which can very effectively and particularly reliably be automated.

The stack is in all cases guided throughout its movement until it enters the container, this preventing it from being deformed or shifted, the envelopes always remaining in the precise order of their stacking.

Finally, the opening of the retractable flaps can be made to correspond exactly to the maximum dimension of the envelopes, the edges of these flaps, at the same time as the rollers of the two stops, playing a part in guiding the stack in its movement.

Of course it goes without saying that the invention is not limited to the embodiment more particularly described with reference to the appended drawings; on the contrary it encompasses all alternatives thereof. In particular, it is advantageously possible to envisage adjusting the operation of the ram actuating the retractable flaps using any appropriate means so that the travel of this ram initially undergoes strong acceleration and, at the end of its movement, undergoes deceleration before the flaps stop, to avoid these bouncing.

We claim:

1. A device for automatically filling a container for collecting flat objects comprising:

a receiving location where envelopes are received, one-by-one and stood up on their edge, from a conveyor with driving belts pinching the envelopes between them until they are released into the location in order to form a stack, the receiving location including at least two opposite parallel jogging edges extending perpendicularly to the planes of the successive envelopes in the stack formed between the edges, and a horizontal bearing sole, the first envelope in the stack being pressed against a moving stop which moves in a horizontal direction as the stack is formed, wherein the bearing sole comprises two retractable flaps placed in the same horizontal plane in order to support the stack of envelopes, wherein the flaps are mounted so that they can pivot about a respective one of two parallel axles and, wherein the flaps are operated in synchronism by a means for tilting the flaps about the axles so that the stack is released and drops under gravity between the pivoted flaps into the container located under these flaps at the receiving location.

2. Device according to claim 1, wherein the moving stop includes at least one guide roller which is free to rotate about a horizontal axle parallel to the plane of the envelopes and able to guide the stack as it moves towards the collecting container.

3. Device according to claim 2, wherein the moving stop consists of a plurality of super-imposed rollers.

4. Device according to claim 1, further including a second stop which can be pressed against the last envelope in the stack once this stack has been formed, prior to the mechanism causing the two retractable flaps to tilt being operated to drop the stack into the collecting container.

5. Device according to claim 4, wherein said second stop includes rollers for guiding the envelopes, the stack being held laterally as it drops between the rollers of the two stops.

6. Device according to claim 4, wherein said second stop is borne by a pivoting arm articulated about a vertical axle so as to allow sufficient clearance from this stop as the stack is being formed and the pressing of this stop against the last envelope of the stack at the moment when the operating mechanism causes the two retractable flaps to tilt.

7. Device according to claim 1, wherein said moving stop includes a crosspiece exhibiting two lateral extensions which are equipped with means able to move the stop along two rails of a structure provided in the receiving location, these rails guiding the stop in its movement.

8. Device according to claim 7, wherein a relay is mounted at an end of the rails, said relay having a contact which is actuated by the crosspiece of the moving stop at the end of its travel, so as to determine the instant at which the stack is finished and operate the tilting mechanism of the retractable flaps.

9. Device according to claim 1, wherein the receiving location includes slideways for supporting the collecting container, these slideways being located underneath the retractable flaps.

10. Device according to claim 1, wherein each of said retractable flaps includes a flat bottom with a lateral return forming a jogging edge for the envelopes in the stack, this return being equipped with a clevis through which the pivot axle of the flap passes, this clevis further being secured to a link rod articulated to a double-acting ram located parallel to the plane of the bearing sole of the stack, so that extending or contracting this ram determines the pivoting of the link rod for each flap and causes the two flaps to tilt or to come to face one another in the same horizontal plane.

11. Device according to claim 10, wherein said link rods between the two flaps and the double-acting operating ram are mounted at the opposite end of the receiving location to the belt conveyor.

12. Device according to claim 10, wherein said retractable flaps are made to tilt by a stroke of the ram such that the separation between the edges of the envelopes relative to these flaps as the stack drops corresponds substantially to the width of these envelopes.

* * * * *